US006465412B1

(12) United States Patent
Mahieu et al.

(10) Patent No.: US 6,465,412 B1
(45) Date of Patent: Oct. 15, 2002

(54) ANTIMICROBIAL SCALE CLEANING COMPOSITION COMPRISING POLYHEXAMETHYLENE BIQUANIDE HYDROCHLORIDE

(75) Inventors: Marianne Mahieu, Ayeneux (BE); Germaine Zocchi, Villers aux Tours (BE)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

(21) Appl. No.: 10/103,464

(22) Filed: Mar. 21, 2002

(51) Int. Cl.[7] ..... C11D 17/00
(52) U.S. Cl. ..... 510/422; 510/434; 510/475; 510/476; 510/499
(58) Field of Search ..... 510/422, 434, 510/475, 476, 499

(56) References Cited

U.S. PATENT DOCUMENTS

| | | | | | |
|---|---|---|---|---|---|
| 4,758,595 | A | * | 7/1988 | Ogunbiyi et al. | 514/635 |
| 5,869,073 | A | * | 2/1999 | Sawan et al. | 424/406 |
| 6,083,517 | A | * | 7/2000 | Anathapadmanabhan et al. | 424/405 |
| 6,264,936 | B1 | * | 7/2001 | Sawan et al. | 424/78.26 |

FOREIGN PATENT DOCUMENTS

| | | | |
|---|---|---|---|
| EP | 0911022 | * | 4/1999 |

* cited by examiner

*Primary Examiner*—Necholus Ogden
(74) *Attorney, Agent, or Firm*—Richard E. Nanfeldt

(57) ABSTRACT

An antibacterial cleaning composition containing at least a surfactant, excluding cationic surfactants, a polyethylene oxide polycarboxylic acid copolymer and water.

2 Claims, No Drawings

ANTIMICROBIAL SCALE CLEANING COMPOSITION COMPRISING POLYHEXAMETHYLENE BIQUANIDE HYDROCHLORIDE

FIELD OF THE INVENTION

The present invention relates to an antimicrobial cleaning composition for cleaning surfaces which provides a lasting antibacterial protection on the surface being cleaned, wherein the composition includes a polyethylene oxide polycarboxylate copolymer, polyhexamethylene biguanide hydrochloride, optionally, a surfactant and water.

BACKGROUND OF THE INVENTION

Poly(hexamethylene biguanide)hydrochloride has been used in the food industry as an antibacterial solution for equipment disinfection but these solutions exhibit poor substantivity.

Numerous cleaning compositions have been disclosed in various patents. However, a major problem with these cleaning compositions is that bacteria is not effectively killed on the surface being treated and no protection is provided on the surface against the future growth of bacteria.

Poly(hexamethylene biguanide)hydrochloride has been used in combination with a cationic surfactant such as didecyl dimethyl ammonium chloride in laundry compositions but the substantivity of these laundry compositions is inferior.

Patent applications WO99/40791 and EPO891712A1 comprises a substantive antibacterial solution containing silver ions, poly(hexamethylene biguanide)hydrochloride which is crosslinked by sodium lauryl sulfate.

Avecia Limited of England also provides poly (hexamethylene biguanide)stearate for soap bars.

EP-0875554 teaches the use of an acid-stable polymer selected from the group consisting of a polycarboxylate, a sulphonated polystyrene polymer, a vinylpyrrolidone homo/copolymer, a polyalkoxylene glycol, and mixture thereof, in a liquid acidic composition having a pH below 5. Said acidic compositions are suitable for removing limescale-containing stains from a hard-surface.

EP-0983294 describes a liquid composition having a pH of from 7 to 14 for cleaning hard surfaces, comprising a homo or copolymer of vinylpyrrolidone and a polysaccharide polymer. However, no liquid neutral pH compositions as described in the present invention comprising a polyalkylene oxide polycarboxylate copolymer are disclosed therein.

The exploitation of interpolyelectrolyte reaction (PHMB with polyacrylic acid) has already been exploited to prepare antimicrobial fibres, but in this case the anionic polymer was chemically grafted on the cellulose (Virnik A. D., Penenzhik M. A., Grishin M. A., Rishkina I. S., Zezin A. B., Rogacheva V. B. 1994. Interpolyelectrolyte reactions between polyhexamethylene guanidine and polyacrylic acid grafted on cellulose: a new method for the preparation of antimicrobial fibrous material. Cellulose Chem. Technol. 28, 11–19).

SUMMARY OF THE INVENTION

The present invention relates to an antimicrobial cleaning composition having improved substantivity which comprises a polyhexamethylene biguanide hydrochloride, a polyethylene oxide polycarboxylate copolymer, optionally a surfactant selected from the group consisting of anionic, zwitterionic surfactants and nonionic surfactants and mixtures thereof, and water, wherein the composition does not contain silicon containing polymer, amino containing polymers, copolymers of polyvinyl pyrrolidone or polyvinyl pyrridine N-oxide polymers.

It is an object of the instant invention to provide an antibacterial cleaning composition, wherein the polymer links with the polyhexamethylene biguanide hydrochloride and the surface to improve the deposition and the resistance to rinse off of the polyhexamethylene biguanide hydrochloride from the surface being cleaned.

DETAILED DESCRIPTION OF THE INVENTION

The present invention relates to a hard surface cleaning composition which renders the surface being treated resistant to the growth of bacteria, wherein the composition comprises approximately by weight:

(a) 0 to 10%, more preferably 0.1% to 5% of at least one surfactant, selected from the group consisting of anionic surfactants, amine oxide surfactants, zwitterionic surfactants and nonionics and mixtures thereof;

(b) 0.01% to 5%, more preferably 0.1% to 3% of a polymer which is a polyethylene oxide polycarboxylate copolymer;

(c) 0.01% to 5%, more preferably 0.01% to 1% of polyhexamethylene biguanide hydrochloride; and (d) the balance being water, wherein the composition does not contain an amino containing polymer, a silicon containing polymer, a cationic surfactant, a copolymer of polyvinyl pyrrolidone or polyvinyl pyrridine N-oxide polymers.

The zwitterionic surfactant used is a water soluble betaine having the general formula

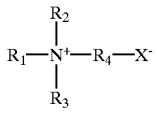

wherein X— is selected from the group consisting of COO— and SO3—and $R_1$ is an alkyl group having 10 to about 20 carbon atoms, preferably 12 to 16 carbon atoms, or the amido radical:

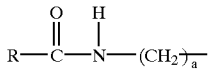

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia)acetate, coco dimethyl betaine or 2-(N-coco N, N-dimethylammonia)acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. The amidosulfobetaines include cocoamidoethylsulfobetaine, cocoamidopropyl sulfobetaine and the like. A preferred betaine is coco ($C_8$–$C_{18}$) amidopropyl dimethyl betaine. Three preferred betaine surfactants are Empigen BS/CA from Albright and Wilson, Rewoteric AMB 13 and Goldschmidt Betaine L7.

Regarding the anionic surfactant present in the compositions any of the conventionally used water-soluble anionic surfactants or mixtures of said anionic surfactants can be used in this invention. As used herein the term "anionic surfactant" is intended to refer to the class of anionic and mixed anionic-nonionic detergents providing detersive action.

Suitable water-soluble non-soap, anionic surfactants include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

The anionic surfactants which may be used in the composition of this invention are water soluble and include the sodium, potassium, ammonium and ethanolammonium salts of linear $C_8$–$C_{16}$ alkyl benzene sulfonates, alkyl ether carboxylates, $C_{10}$–$C_{20}$ paraffin sulfonates, $C_8$–$C_{18}$ alkyl sulfates, alkyl ether sulfates and mixtures thereof.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms. Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an a-olefin.

Examples of satisfactory anionic sulfate surfactants are the alkyl sulfate salts and the and the alkyl ether polyethenoxy sulfate salts having the formula $R(OC_2H_4)_n OSO_3M$ wherein n is 1 to 12, preferably 1 to 5, and R is an alkyl group having about 8 to about 18 carbon atoms, more preferably 12 to 15 and natural cuts, for example, $C_{12-14}$ or $C_{12-16}$ and M is a solubilizing cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

The ethoxylated alkyl ether sulfate may be made by sulfating the condensation product of ethylene oxide and $C_{8-18}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred alkyl ether sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

Other suitable anionic detergents are the $C_9$–$C_{15}$ alkyl ether polyethenoxyl carboxylates having the structural formula $R(OC_2H_4)_nOX$ COOH wherein n is a number from 4 to 12, preferably 6 to 11 and X is selected from the group consisting of $CH_2$, $C(O)R_1$ and

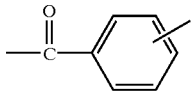

wherein $R_1$ is a $C_1$–$C_3$ alkylene group. Preferred compounds include $C_9$–$C_{11}$ alkyl ether polyethenoxy (7–9) $C(O)CH_2CH_2COOH$, $C_{13}$–$C_{15}$ alkyl ether polyethenoxy (7–9)

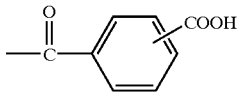

and $C_{10}$–$C_{12}$ alkyl ether polyethenoxy (5–7) $CH_2COOH$. These compounds may be prepared by condensing ethylene oxide with appropriate alkanol and reacting this reaction product with chloracetic acid to make the ether carboxylic acids as shown in U.S. Pat. No. 3,741,911 or with succinic anhydride or phtalic anhydride.

Obviously, these anionic detergents will be present either in acid form or salt form depending upon the pH of the final composition, with the salt forming cation being the same as for the other anionic detergents.

The amine oxide is depicted by the formula:

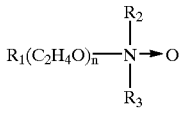

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms; $R_2$ and $R_3$ are each methyl, ethyl, propyl, isopropyl, 2-hydroxyethyl, 2-hydroxypropyl, or 3-hydroxypropyl; and n is from 0 to about 10. Particularly preferred are amine oxides of the formula:

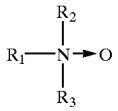

wherein $R_1$ is a $C_{12-18}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference. An especially preferred amine oxide is depicted by the formula:

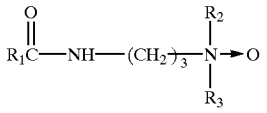

wherein $R_1$ is a saturated or unsaturated alkyl group having about 6 to about 24 carbon atoms, $R_2$ is a methyl group, and $R_3$ is a methyl or ethyl group. The preferred amine oxide is cocoamidopropyl-dimethylamine oxide.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 2.5 to 10 moles of ethylene oxide (NEODOL 91-2.5 OR-5 OR-6 OR-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic surfactants are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described composition. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic surfactants are marketed under the trade name "Pluronics". The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

The alkyl polysaccharides surfactants, which are used in the instant composition with the aforementioned surfactants have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, PA. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The polyhexamethylene biquanide (PHMB) used in the instant composition has the following structure:

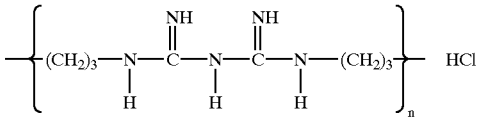

where the average n=4 to 6

The polymer used in the instant compositions is a polyethylene oxide polycarboxylic acid copolymer having the structure of:

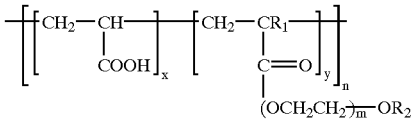

wherein $R_1$ is H or methyl group, $R_2$ is H or an alkyl group having from 1 to 4 carbons and preferably 1 carbon, the ratio of x to y is about 1:1 to 10:1, preferably 9:1, m is about 20 to 200, preferably about 90, the weight ratio of polycarboxylate to polyethylene oxide side chains is about 50/50 to 10/90 and preferably 20/80 and the molecular mass is about 20,000 to about 200,000, more preferably about 100,000. A preferred copolymer is an acrylic acid-polyethylene glycol monomethyl ether monomethacrylate copolymer sold by BASF as Sokalan HP80 or Sokalan PM70.

The surfactants, the polyethylene oxide polycarboxylic acid copolymer and polyhexamethylene biguanide hydrochloride are solubilized in the water. To the composition can also be added water soluble hydrotropic salts which include sodium, potassium, ammonium and mono-, di- and triethanolammonium salts. While the aqueous medium is primarily water, preferably said solubilizing agents are included in order to control the viscosity of the liquid composition and to control low temperature cloud clear properties. Usually, it is desirable to maintain clarity to a temperature in the range of 4° C. to 20° C. Therefore, the proportion of solubilizer generally will be from 0.1% to 15%, preferably 0.5% to 12%, most preferably 0.5% to 8%, by weight of the detergent composition with the proportion of ethanol, when present, being 5% of weight or less in order to provide a composition having a flash point above 46° C. Preferably the solubilizing ingredient will be a mixture of ethanol and either sodium xylene sulfonate or sodium cumene sulfonate or a mixture of said sulfonates or ethanol and urea. Other solubilizing agents can be ethylene glycol, propylene glycol, ethylene glycol monobutyl ether (butyl cellosolve), diethylene glycol monobutyl ether (butyl carbitol), propylene glycol monomethyl ether, dipropylene glycol monomethyl ether, triethylene glycol monobutyl ether, mono, di, tripropylene glycol monobutyl ether, tetraetylene glycol monobutyl ether, mono, di, tripropylene glycol monomethyl ether, ethylene glycol monohexyl ether, diethylene glycol monohexyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monopropyl ether, triethylene glycol monoethyl ether, triethylene glycol monomethyl ether, triethylene glycol monopentyl ether, triethylene glycol monohexyl ether, mono, di, tripropylene glycol monopropyl ether, mono, di, tripropylene glycol monoethyl ether, mono, di, tripropylene glycol monopentyl ether, mono, di, tripropylene glycol monohexyl ether, mono, di, tributylene glycol monomethyl ether, mono, di, tributylene glycol monohexyl ether, mono, di, tributylene glycol monopropyl ether, mono, di, tributylene glycol monoethyl ether, mono, di, tributylene glycol monopentyl ether, mono, di, tributylene glycol monobutyl ether, ethylene glycol monoacetate and dipropylene glycol propionate.

Inorganic salts such as sodium sulfate, magnesium sulfate, sodium chloride and sodium citrate can be added at concentrations of 0.5 to 4.0 wt. % to control the haze of the resultant solution. Magnesium salt can be used with formulations at neutral or acidic pH since magnesium hydroxide will not precipitate at these pH levels. Various other ingredients such as urea at a concentration of 0.5 to 4.0 wt. % or urea at the same concentration of 0.5 to 4.0 wt. % can be used as solubilizing agents. Other ingredients which have been added to the compositions at concentrations of 0.01 to 4.0 wt. % are perfumes, sodium bisulfite, EDTA and HETDA. The foregoing solubilizing ingredients also facilitate the manufacture of the inventive compositions because they tend to inhibit gel formation.

The liquid compositions of the present invention have a pH of about 3 to about 8, more preferably about neutral. Thus, they may comprise as an optional ingredient a source of acidity or alkalinity for the purpose of pH adjustment. Suitable sources of acidity for use herein are lactic acid, citric acid, sulfuric acid and hydrochloric acid. Suitable sources of alkalinity for use herein are the caustic alkalis such as sodium hydroxide or potassium hydroxide.

In addition to the previously mentioned essential and optional constituents of the compositions, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers, preservatives; etc. The proportion of such adjuvant materials, in total will normally not exceed 15% of weight of the detergent composition, and the percentages of most of such individual components will be a maximum of 5% by weight and preferably less than 2% by weight.

One emulsifier used in the instant composition is LRI manufactured by Wackherr which is a mixture of a PEG-40 hydrogenated Castor oil and PPG-26 buteth 26. Other useful emulsifiers are all the surfactants that can be used to solubilize perfumes or other lipophilic ingredients into water as the surfactants belonging to the following families and showing an HLB higher than 12: the ethoxylated fatty alcohols, ethoxylated lanolin, ethoxylated glycerides or ethoxylated hydroxylated glycerides, ethoxylated amides, ethoxylated carboxylic acids (polyethylene glycol acylates and di-acylates), EO-PO block copolymers or any propoxylated PEO ethers as well as sorbitan and sorbitol esters. More specifically, the following examples can be mentionned:

Ethoxylated castor oil or ethoxylated hydrogenated castor oil as Arlatone 289, 650 and 827 from Imperial Chemical Industries; all mixtures containing ethoxylated castor oil or ethoxylated hydrogenated castor oil as Arlatone 975 and Arlatone 980 from or Imperial Chemical Industries or also the Emulsifier 2/014160 from Dragoco which is a mixture of fatty alcohol polyglycolether and hydrogenated castor oil ethoxylate; all the ethoxylated alkyl alcohol as the range of Brij surfactants from Imperial Chemical Industries or also Arlasolve 200 which is an ethoxylated isohexadecyl alcohol; all the polyethyleneglycol sorbitan mono- and tri- alkanoic acid esters from Imperial Chemical Industries, especially Tween 20 which is polyoxyethylene (20) sorbitan monolaurate.

The instant compositions are readily made by simple mixing methods from readily available components which, on storage, do not adversely affect the entire composition.

The instant composition liquids are readily made by simple mixing methods from readily available components which, on storage, do not adversely affect the entire composition.

The following examples illustrate liquid cleaning compositions of the described invention. The exemplified compositions are illustrative only and do not limit the scope of the invention. Unless otherwise specified, the proportions in the examples and elsewhere in the specification are by weight.

EXAMPLE 1

Measure of the Deposition of PHMB on Ceramic Tiles in Presence of Sokalan HP80 by Colorimetry Methodology 200 μl of each solution to test is deposited on a 2.5×2.5 $cm^2$ ceramic tile. After drying at room temperature, the treated tiles are rinsed with 2×10 ml deionized water. The revelation is then performed with 200 μl Indigotine ex. Wackherr at 0.033% in deionized water (3 minutes contact). After removing the excess of dye with 10 ml deionized water and drying of the surface, the coloration intensity is measured with a chromameter (Minolta CR200®). ΔE measures the global difference of coloration versus the reference tile (no treatment, no contact with the dye). The Indigotine dye does interact neither with the ceramic surface nor with the anionic polymer. The coloration of the tile is the signal of the persistence of the PHMB on the surface after rinsing. The intensity of the coloration is related to the quantity of PHMB on the surface and to the availability of the cationic charges, which is essential for the antibacterial efficiency of the active.

| | ΔE | |
|---|---|---|
| | Working pH = 3.5 | Working pH = 6.5 |
| PHMB 'alone' | 2.89 | 4.52 |
| Sokalan HP80 0.1% | 0.31 | 0.24 |
| Sokalan HP80 0.2% | 0.27 | 0.31 |
| Sokalan HP80 0.3% | 0.20 | 0.24 |
| PHMB 0.2% + Sokalan HP80 0.1% | 5.32 | 9.54 |
| PHMB 0.2% + Sokalan HP80 0.2% | 7.32 | 10.00 |
| PHMB 0.2% + Sokalan HP80 0.3% | 9.01 | 11.46 |

In presence of HP80, the resistance to rinse of PHMB is better. This is translated by a higher retention of the dye onto the surface, a higher coloration intensity and a higher value of ΔE. Results are better at pH 6.5 than at pH 3.5.

EXAMPLE 2

Measure of the Lasting Antibacterial Protection of the Surface Methodology (SOP52004-001)

Ceramic tiles are treated with 200 μl of the solutions to test; untreated tiles are used as reference. After drying of the treatment up to the next day (about 15 hours), a rinsing is possibly performed, either with 2×10 ml or 5×10 ml deionized water or under the tap water shower during 30 seconds which corresponds to about 150 ml per tile; unrinsed tiles are used as reference. After rinsing, the tiles are let dry for 1 hour. All the tiles (untreated/treated/rinsed/unrinsed) are then inoculated in the horizontal position for 5 hours with 200 μl of a suspension of wild germs from hand's volunteers (mainly *Staphylococcus epidermitis*). After gentle rinsing of the surface with 2×10 ml sterile tap water to remove the germs source, the contamination of the surface is determined by direct imprint on Rodac™ agar plates. Colony forming units are counted after 24 hours incubation at RT.

Results:

Nd: not determined

Number of colony forming units (cfu)=number of germs on the ceramic tile.

Working pH=3.5

| | Number of cfu/tile | | | |
|---|---|---|---|---|
| | Un-treated tile | Treated with PHMB 0.2% 200 μl/tile pH = 3.5 | Treated with HP80 0.3% 200 μl/tile pH = 3.5 | Treated with PHMB 0.2% + HP80 0.3% 200 l/tile pH = 3.5 |
| No rinsing | 818 | 0 | 317 | 0 |
| Treatment rinsed with 2 × 10 ml deionized water | 614 | 40 | nd | 0 |
| Treatment rinsed with 5 × 10 ml deionized water | 428 | 75 | nd | 29 |
| Treatment rinsed during 30" under tap water shower | 346 | 163 | nd | 72 |

Working pH=6.5—First test

| | Number of cfu/tile | | | |
|---|---|---|---|---|
| | Un-treated tile | Treated with PHMB 0.2% 200 μl/tile pH = 6.5 | Treated with HP80 0.3% 200 μl/tile pH = 6.5 | Treated with PHMB 0.2% + HP80 0.3% 200 l/tile pH = 6.5 |
| No rinsing | 818 | 0 | 506 | 0 |
| Treatment rinsed with 2 × 10 ml deionized water | 614 | 3 | nd | 0 |
| Treatment rinsed with 5 × 10 ml deionized water | 428 | 5 | nd | 0 |
| Treatment rinsed during 30" under tap water shower | 346 | 53 | nd | 0 |

Working pH=6.5—Second test

| | Number of cfu/tile | | |
|---|---|---|---|
| | Un-treated tile | Treated with PHMB 0.2% 200 μl/tile pH = 6.5 | Treated with PHMB 0.2% + HP80 0.3% 200 l/tile pH = 6.5 |
| No rinsing | 1094 | 0 | 0 |
| Treatment rinsed with 2 × 10 ml deionized water | 851 | 0 | 0 |
| Treatment rinsed with 5 × 10 ml deionized water | 798 | 13 | 0 |
| Treatment rinsed during 30" under tap water shower | 802 | 378 | 0 |

The presence of Sokalan HP80 polymer improves the resistance to rinse of the PHMB antibacterial agent and ensures a better antibacterial protection of the surface in case of rinsing. Again, results are better at pH6.5.

What is claimed is:

1. An antimicrobial hard surface cleaning composition which comprises:

(a) 0.01% to 5% of polyhexamethylene biquanide hydrochloride;

(b) 0.01% to 5% of a polyethylene oxide polycarboxylic acid copolymer having the structure of:

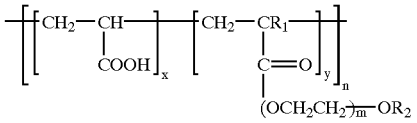

wherein $R_1$ is H or methyl group, $R_2$ is H or an alkyl group having from 1 to 4 carbons, the ratio of x to y is about 1:1 to 10:1, m is about 20 to about 200, the weight ratio of polycarboxylate to polyethylene oxide side chains is about 50/50 to 10/90 and preferably 20/80 and the molecular mass is about 20,000 to about 200,000;

(c) 0.01 wt % to 5 wt. % of a surfactant selected from the group consisting of anionic surfactants, nonionic surfactants, zwitterionic surfactants and mixtures thereof; and (d) the balance being water and wherein the composition does not contain silicone-containing polymer, amino containing polymers, copolymers of polyvinyl pyrrolidone or polyvinyl pyridine N-oxide polymers.

2. The composition of claim 1 wherein polyethylene oxide polycarboxylic acid copolymer is acrylic acid-polyethylene glycol monomethyl ether monomethacrylate copolymer.

* * * * *